US009451799B2

(12) United States Patent
Conrad

(10) Patent No.: US 9,451,799 B2
(45) Date of Patent: Sep. 27, 2016

(54) METHOD AND APPARATUS FOR RAPID EVACUATION OF INJURED PERSONS FROM HOSTILE ENVIRONMENTS

(71) Applicant: Douglas Conrad, Keota, IA (US)

(72) Inventor: Douglas Conrad, Keota, IA (US)

(73) Assignee: Daart-Net Industries LLC, Keota, IA (US)

( * ) Notice: Subject to any disclaimer, the term of this patent is extended or adjusted under 35 U.S.C. 154(b) by 0 days.

(21) Appl. No.: 14/885,051

(22) Filed: Oct. 16, 2015

(65) Prior Publication Data

US 2016/0106168 A1 Apr. 21, 2016

Related U.S. Application Data

(60) Provisional application No. 62/065,287, filed on Oct. 17, 2014.

(51) Int. Cl.
*A41F 9/00* (2006.01)
*F41H 1/02* (2006.01)

(52) U.S. Cl.
CPC ..... *A41F 9/005* (2013.01); *F41H 1/02* (2013.01)

(58) Field of Classification Search
CPC ..... F41H 1/02; A41D 1/04; A41D 13/0015; A41D 13/0012; A41D 3/00; A61F 5/028
USPC ..... 2/2.5, 102, 44, 69.94, 108
See application file for complete search history.

(56) References Cited

U.S. PATENT DOCUMENTS

| | | | | |
|---|---|---|---|---|
| 4,449,253 | A * | 5/1984 | Hettinger | A41D 13/0007 2/93 |
| 4,854,418 | A * | 8/1989 | Hengstenberger | A62B 35/0037 182/3 |
| 5,738,046 | A * | 4/1998 | Williams | A41D 13/0007 119/770 |
| 6,205,584 | B1 * | 3/2001 | Yocco | A41D 13/0007 182/3 |
| 6,276,006 | B1 | 8/2001 | Hoit | |
| 6,427,252 | B1 * | 8/2002 | Lewis | A41D 13/0007 182/3 |
| 7,266,850 | B1 * | 9/2007 | Strum | F41H 1/02 2/2.5 |
| 7,490,358 | B1 * | 2/2009 | Beck | A41D 13/0531 2/102 |
| 7,665,153 | B2 * | 2/2010 | Grilliot | A41D 13/0007 182/3 |
| 8,015,619 | B2 * | 9/2011 | McKay | A62B 35/0006 2/69 |
| 8,281,430 | B1 | 10/2012 | Hough et al. | |

* cited by examiner

*Primary Examiner* — Tejash Patel
(74) *Attorney, Agent, or Firm* — Simmons Perrine Moyer Bergman PLC

(57) ABSTRACT

A system and method of evacuating a downed tactical operator from a hostile environment comprising adding an evacuation belt strap to a PALS grid on a body armor vest by using belt keepers. The evacuation belt strap is made by forming loops at the ends of the strap to function as handles to be grasped by rescuers of the downed operator.

4 Claims, 6 Drawing Sheets

Fig. 2: Front of Evac-Strap with belt keepers L1 and R1 closed

Fig. 3: Reverse side of Evac-Strap with belt keepers L1 and R1 closed

METHOD AND APPARATUS FOR RAPID EVACUATION OF INJURED PERSONS FROM HOSTILE ENVIRONMENTS

FIELD OF THE INVENTION

The present invention generally relates to transporting injured persons, and more particularly relates to body-worn immediately accessible personnel evacuation aids.

BACKGROUND OF THE INVENTION

In the past, numerous devices have been invented for transporting people who need assistance. One example of such a system is shown in U.S. Pat. No. 6,276,006, issued to Hoit. This is a seat-like sling for transporting a disabled person from a seat such as on an aircraft. This requires that the device be placed under the person to be aided. Another example is shown in U.S. Pat. No. 8,281,430 issued to Hough, et al. This, too, requires that the sling be moved under the person to be carried.

While these types of sling-like systems may have many advantages in particular applications, they also have some drawbacks. For example, the effort of inserting the sling under the person may seem simple, but in extremely urgent situations, such as a tactical operator injured by gunfire, it can consume precious seconds.

Consequently, there exists a need for improved methods and apparatuses for efficiently removing a downed operator without having to slow down to attach anything to the operator and without the need to insert a sling etc. under the operator's body.

SUMMARY OF THE INVENTION

It is an object of the present invention to provide an easily implemented and cost efficient way to improve survival rates of downed operators in hostile environments.

It is a feature of the present invention to utilize an evacuation strap mounted to an operator's body armor.

It is an advantage of the present invention to provide for a low cost, easily implemented, aftermarket improvement to body armor.

The present invention is an apparatus and method for efficiently and cost effectively providing an evacuation accessory to body armor which is designed to satisfy the aforementioned needs, provide the previously stated objects, include the above-listed features, and achieve the already articulated advantages. The present invention is carried out in an "after injury attachment-less" manner, in a sense that there is no need to attach anything to a downed operator after an injury occurs.

Accordingly, the present invention is a method of evacuating an operator via a method of increasing a utility characteristic of a body armor garment by facilitating evacuation comprising the steps of:

a. providing a body armor garment with a pouch attachment ladder system (PALS) grid;
b. providing a strap having a handle at each end of the strap;
c. providing a plurality of belt keepers, and
d. attaching the strap to the PALS grid using said plurality of belt keepers.

Additionally, the present invention is a method for upgrading utility of existing body armor to include a system for evacuating a downed person from a hostile environment comprising:

a. a body armor vest comprising a PALS grid, configured to be worn by a first person;
b. a first handle disposed on a first side of said garment;
c. a second handle disposed on a second side of said garment; and
d. said first handle and said second handle each being sized and located, to be grasped by hands of persons other than said first person and constructed to support the entire weight of the body of said first person and to be used by said persons other than said first person, to lift said first person and move said first person.

BRIEF DESCRIPTION OF THE DRAWINGS

The invention may be more fully understood by reading the foregoing description of the preferred embodiments of the invention, in conjunction with the appended drawing wherein.

DETAILED DESCRIPTION

Although described with particular reference to body armor, the present invention is capable of being used with any garment or body worn device which contains a Pouch Attachment Ladder System (PALS) grid, or similar but non-PALS, grid or any suitable devices or structures.

Figure 1:
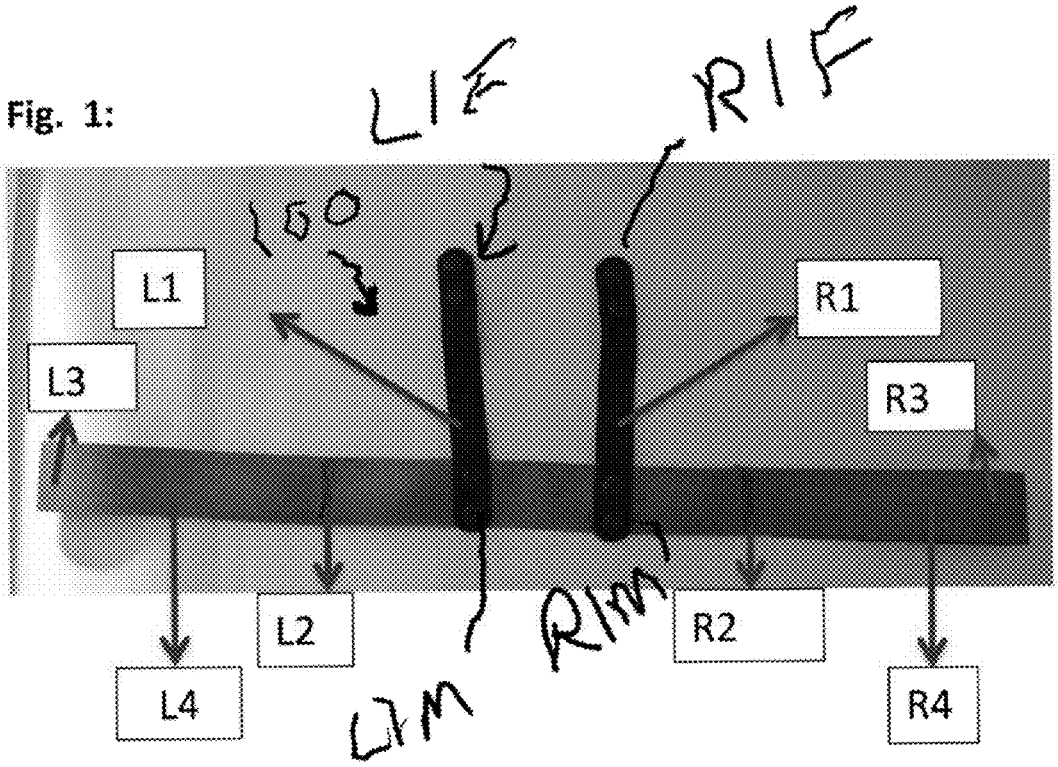
FIG. 1 is a plan view of a front side of the present invention with belt keepers shown in an open configuration.

Now referring to the figures, wherein like numerals refer to like matter throughout, and more particularly referring to FIG. 1, there is shown an evacuation belt strap of the present invention, generally designated 100. Evacuation belt strap 100, which in one embodiment is simply a single continuous piece of automotive type seat belt strap made up with a looped handle on each end, the evacuation belt strap 100 is mounted to the body armor of a tactical operator using belt keepers before the body armor is worn in the field by the operator. In general, the invention, when fully constructed, may end up being roughly 18-20 inches wide (after the formation of the loops for handles) and be roughly two inches (2") tall (the polyester or nylon strap approximately 2" wide) and is roughly 2 mm thick where not doubled over. Many variations of seat belt strap exist and many would be suitable for the present invention. The evacuation belt strap 100 is symmetrical about its center with a right side belt keeper R1 typically disposed on a single width belt strap portion. However, the present invention could, in some embodiments be first made, first into a single loop and then sewn with addition sections to form handles.

Figure 5:
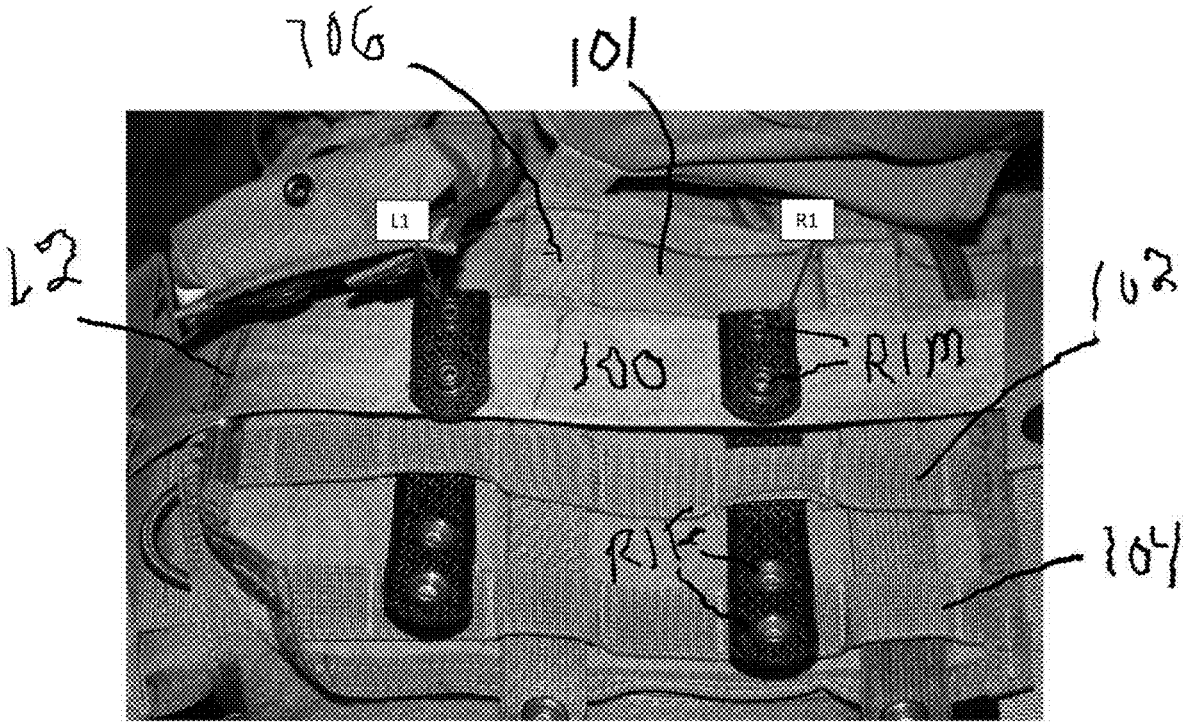
FIG. 5 is a view of the front side of the present invention partially installed on a body armor garment.
Figure 6:
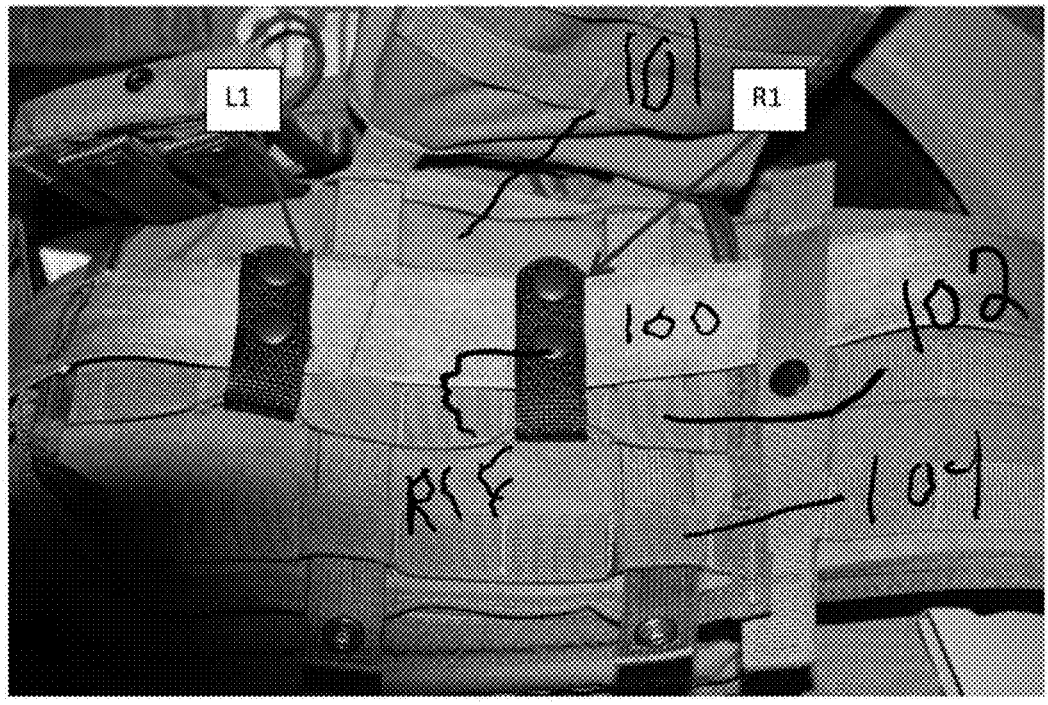
FIG. 6 is a view of present invention of FIG. 5 after being fully installed.

The term "belt keeper" is used herein to refer to small elongated two sided flat straps which have male snaps on a first side of one end and female snaps on a second opposing side of an opposite end of the strap (the snaps of the belt keepers are more visible in FIGS. 5 and 6). Belt keepers are frequently used by tactical operators to couple a heavily loaded duty belt of often two inches (2") in width or more to a normal pants belt. Belt keepers are widely available and are made with various materials such as nylon, polyester, polypropylene, leather, rubber, cotton or other suitable material. While the belt keepers are described here as having two ends and using male and female snaps to attach the two ends; other means for attaching the two ends include: buttons and button holes, Velcro and other hook and loop fasteners, stitching, adhesives, rivets, staples, or suitable substitutes.

Right side belt keeper R1 is positioned so that the two male snaps R1M are positioned over the evacuation belt strap 100 and exposed (facing away from the evacuation belt strap 100) and the top end of right side belt keeper R1 are the female snaps R1F. Then as viewed moving to the right, right side folded over strap stitching R2 is shown where the strap material is folded back around and sewed back on itself at right side folded over strap stitching R2. This creates a loop right side handle R3 out of the portion right side folded strap portion R4. The left side is symmetrical and includes left side belt keeper L1, left side folded over strap stitching L2, left side handle L3 and left side folded strap portion L4. These belt keepers do not have to be stitched to the evacuation belt strap 100 but some applications where the invention will be used on only one type of body armor may prefer an attachment to make the installation process onto the predetermined body armor quicker and easier. In other applications, the belt keepers might not be fixed to any portion of the evacuation belt strap 100 so they can accommodate different separation distances and belt keeper numbers and configurations for attachment to the body armor. The right side folded over strap stitching R2 is preferably very strong stitching which provides for very secure attachment of the end of the evacuation belt strap 100 material to create the right side handle R3. The stitching to form any loops with the evacuation belt strap 100 material may be done in a manner similar to sewing automotive seat belts.

Figure 2:
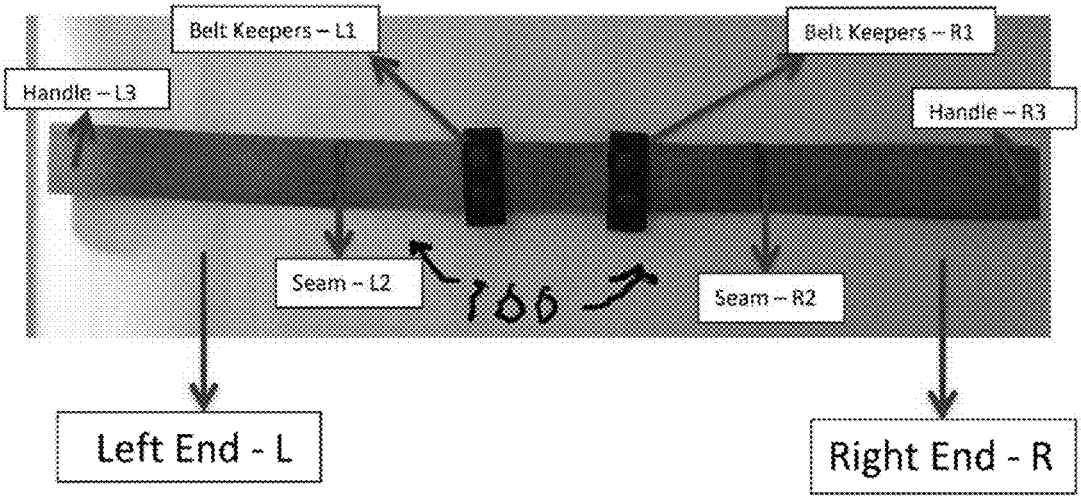
FIG. 2 is a plan view of a front side of the present invention with belt keepers shown in a closed configuration.

Now referring to FIG. 2, the present invention is shown just as in FIG. 1 except now with the right side belt keeper R1 and left side belt keeper L1 female snaps R1F and L1F, respectively, are folded behind the evacuation belt strap 100 then back up and snapped shut over the R1M and L1M snaps, respectively.

Figure 3:
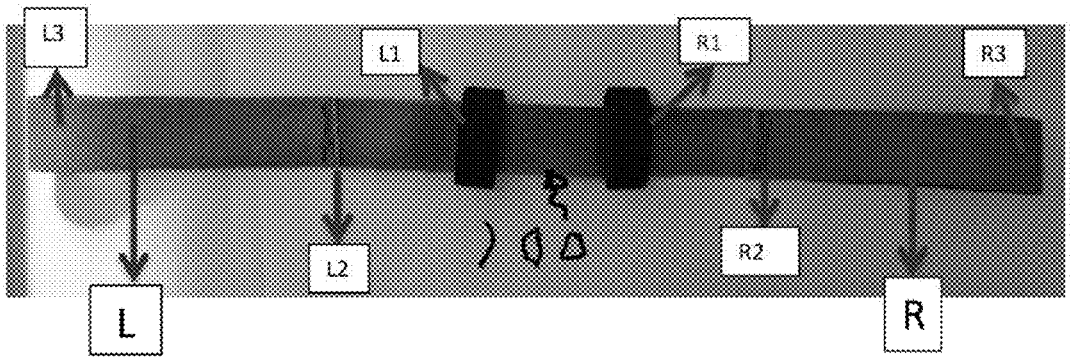
FIG. 3 is a plan view from a reverse side of the present invention as shown and configured in FIG. 2.

Now referring to FIG. 3, there is shown the present invention in the configuration of FIG. 2 except showing the reverse side of evacuation belt strap 100.

Figure 4:
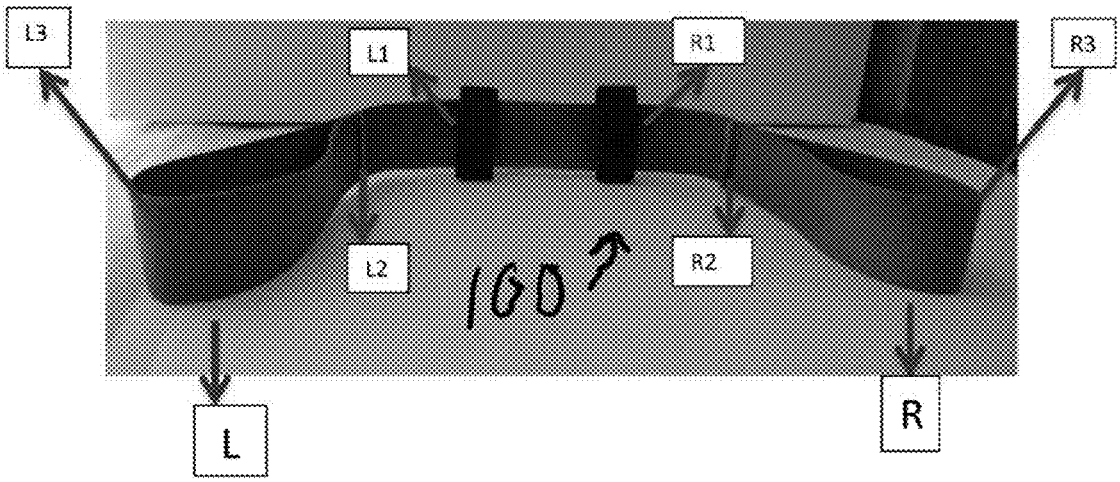
FIG. 4 is a perspective view of the present invention as shown and configured in FIG. 3.

Now referring to FIG. 4, there is shown a perspective view of the evacuation belt strap 100 with the reverse side (as shown in FIG. 3) in the foreground. The right side handle R3 and left side handle L3 are more visible in this figure and it is easier to see that right side folded over strap stitching R2 and left side folded over strap stitching L2 are where the evacuation belt strap 100 material is folded back on itself and stitched.

Now referring to FIG. 5, there is shown a back side portion of a body armor garment 101, which may be a Diamond Back Tactical plate carrier type body armor vest which is well known in the art and is commercially available. The present invention is intended to work with such body armor and other body armor garments that have a PALS grid, or similar non-PALS grid, or the like, thereon. The exposed portion of the PALS grid of body armor garment 101 comprises multiple rows 102 and 104 of heavy straps stitched with predetermined spacing between the straps and the stitching on the straps. These spaces in the stitchings are sized, spaced and configured to allow objects to be attached to the body armor garment.

In this view, only a portion of the present invention is shown, but it is generally oriented as it is shown in FIG. 1, except that the right side belt keeper R1 and the left side belt keeper L1 are folded back and threaded through at least one slot in the (PALS) and are ready to complete the attachment to the body armor via the PALS when right side belt keeper R1 and left side belt keeper L1 are folded up and snapped shut. The evacuation belt strap 100 of the present invention is shown disposed over and partially blocking from view portions of a vertical strap 106, which is between right side belt keeper R1 and left side belt keeper L1. This vertical strap is not part of the evacuation belt strap 100 of the present invention. The left side folded over strap stitching L2 is visible to the left of L1 and it can be seen that to the left of the left side folded over strap stitching L2, the evacuation belt strap 100 material has been folded over to form the loop which is left side handle L3.

It can be seen from FIG. 5 that the spacing between right side belt keeper R1 and left side belt keeper L1 is precisely the width necessary to span two adjacent PALS slots in a PALS horizontal strap. It is believed that such a separation may be optimal in some situations. It should also be understood that different spacing could be used as well as additional belt keepers to provide more strength and redundancy.

It can be seen by now referring to both FIGS. 5 and 6, that one embodiment of a method of the present invention could be as follows: the evacuation belt strap 100 of the present invention is laid across the back of a body armor garment 101, the top of strap 100 is generally aligned with the top of a horizontal PALS strap and the evacuation belt strap 100 is oriented much as it is in FIG. 1. The right side belt keeper R1 and left side belt keeper L1 are on top of the strap 100, and also oriented as in FIG. 1, with the female snaps R1F away from the belt strap 100 and the male snaps disposed on top of the belt strap 100 and facing outward (away from the belt strap 100 and the body armor garment 101). The right female snaps R1F are folded back and threaded under the belt strap 100, through at least one slot in a horizontal PALS strap, across the 1 inch gap between horizontal PALS straps and, if the length of the belt keeper permits, through the corresponding vertically aligned slot in next PALS horizontal strap. The corresponding action is done for left side belt keeper L1. At this stage of installation, the configuration of body armor garment 101 and evacuation belt strap 100 is as shown in FIG. 5.

Then the female snaps R1F of right side belt keeper R1 are folded back up and mated to the male snaps R1M. The corresponding action is taken with left side belt keeper L1. The installation is complete and is configured as shown in FIG. 6. The right side handle R3 and the left side handle L3 are then generally located to the side of the body armor garment where they are positioned for easy grasping by rescuers, if needed.

Belt keepers which will perform with the present invention will have different dimensions. However, it may be preferred that the length of the belt keeper be between 4.5 inches and 7 inches and that they have a width which is between 1.5 inches and 0.5 inches. The measurement of the length of a belt keeper will be the longest straight line that can be drawn from a portion of one snap to a portion of another snap on a single belt keeper. If the belt keeper utilizes non-snap coupling means, then the length dimension is measured as the longest straight line that could be drawn from a point of attachment at one end of a belt keeper to a point of attachment at another end of the belt keeper, if the belt keeper were separated and laid substantially flat. In a preferred embodiment, the belt keeper's lengths may be between 5 inches and 6.5 inches. A preferred width dimension may be between 1.5 inches and ⅞ inch. It should be understood that while belt keepers may be a preferred means for mounting the strap to the PALS grid, other means for mounting the strap to PALS grid include: rope, string, cords, Velcro, string, wire, zip-ties, chain, cable, or any suitable elongated structure which can be run through an opening in a PALS grid and be wrapped around the strap and be secured could be substituted.

The PALS system is described herein as being a plurality of straps with slots therein sewn onto a piece of fabric. However, the present invention is intended to include newer PALS variations which utilize a single piece of material with laser cut opening in said single piece of material. Backwards compatibility is a common feature between the newer PALS variations and older PALS.

The present invention is described above as being a system for evacuating a person from a hostile environment. I contend that my invention is also a kit for converting a commercial-off-the-shelf body armor vest with a PALS grid into a vest with improved utility as an evacuation tool comprising: a strap having handles at each end; a plurality means for mounting the strap to the PALS grid. I contend that my invention is also a method for evacuating non-ambulatory persons from an area comprising: going to a non-ambulatory person wearing a body armor garment with an attached evacuation belt strap, which strap has a first handle on a first end and a second handle on a second end; looking for said first handle; grasping said first handle and applying a force, in a first direction, to said first handle so as to increase a component of a velocity of the non-ambulatory person wearing the body armor garment in said first direction.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A method of increasing a utility characteristic of a body armor garment by facilitating evacuation comprising the steps of:

a. providing a body armor garment with a pouch attachment ladder system (PALS) grid;

b. providing a strap having a handle at each end of the strap;

c. providing a plurality of belt keepers, and d. attaching the strap to the PALS grid using said plurality of belt keepers; wherein said step of providing a plurality of belt keepers comprises providing a plurality of straps each of which has two ends and means for attaching the two ends, a length dimension between 4.5 inches and 7 inches and a width dimension between 1.5 inches and 0.5 inches.

2. The method of claim 1 wherein said length dimension is between 5 inches and 6.5 inches and said width dimension is between 1.5 inches and ⅞ inch.

3. A system for aiding evacuation of a person from a hostile environment comprising:

a. a body armor garment with a pouch attachment ladder system (PALS) grid thereon;

b. a strap having a handle at each end of the strap;

c. a plurality of belt keepers; and d. said strap is attached to the PALS grid using said plurality of belt keepers; wherein said plurality of belt keepers comprises a plurality of straps, each of which has two ends and means for attaching said two ends, a length dimension between 4.5 inches and 7 inches and a width dimension between 1.5 inches and 0.5 inches.

4. The system of claim 3 wherein said length dimension is between 5 inches and 6.5 inches and said width dimension is between 1.5 inches and ⅞ inch.

* * * * *